US008327572B2

(12) United States Patent
Boggan et al.

(10) Patent No.: US 8,327,572 B2
(45) Date of Patent: Dec. 11, 2012

(54) INSULATED GUN PROTECTION ARTICLE

(76) Inventors: Toby Boggan, Coldwater, MS (US); Brian Throneberry, Hernando, MS (US)

( * ) Notice: Subject to any disclaimer, the term of this patent is extended or adjusted under 35 U.S.C. 154(b) by 231 days.

(21) Appl. No.: 12/491,977

(22) Filed: Jun. 25, 2009

(65) Prior Publication Data

US 2011/0023347 A1 Feb. 3, 2011

Related U.S. Application Data

(60) Provisional application No. 61/133,013, filed on Jun. 25, 2008.

(51) Int. Cl.
*F41A 35/00* (2006.01)

(52) U.S. Cl. ..... 42/96

(58) Field of Classification Search ..... 42/96, 74; 206/317

See application file for complete search history.

(56) References Cited

U.S. PATENT DOCUMENTS

| | | | | |
|---|---|---|---|---|
| 3,437,247 | A | 4/1969 | Gantress | |
| 3,665,990 | A * | 5/1972 | Hefner, Jr. | 42/74 |
| 4,433,500 | A | 2/1984 | Kunevicius | |
| 4,644,987 | A | 2/1987 | Kiang | |
| 4,860,479 | A | 8/1989 | Easter | |
| 5,048,217 | A | 9/1991 | Easter | |
| 5,183,953 | A * | 2/1993 | Anderson et al. | 42/96 |
| 5,431,970 | A * | 7/1995 | Broun et al. | 428/36.5 |
| 5,678,344 | A | 10/1997 | Jones et al. | |
| 5,778,590 | A * | 7/1998 | Browning et al. | 42/96 |
| 6,119,388 | A | 9/2000 | Jones et al. | |
| 6,256,922 | B1 * | 7/2001 | Jones et al. | 42/96 |
| 7,185,607 | B1 | 3/2007 | Pearson | |
| 7,360,648 | B1 | 4/2008 | Blaschke | |
| 7,434,683 | B1 | 10/2008 | Harper et al. | |

* cited by examiner

*Primary Examiner* — Michael Carone
*Assistant Examiner* — Reginald Tillman, Jr.
(74) *Attorney, Agent, or Firm* — Wyatt, Tarrant & Combs, LLP; William S. Parks

(57) ABSTRACT

A tight, insulating enclosure for a rifle or shotgun is provided. Such an enclosure envelops the wooden stock and other wooden portions of a suitable firearm, at least, to protect the wooden surfaces thereof during storage, transportation, and utilization. The enclosure itself contains rubberized foam components to impart insulation around the wooden portions as protection against hard and/or extended surfaces that may bump, scratch, dent, or otherwise disfigure the wooden portions of a rifle or shotgun. Furthermore, the enclosure is of a single construction with suitable cut-out portions for movable parts, such as a trigger, a clip, a scope, and the like and is secured around the target firearm in a tight-fitting fashion in order to protect the noted surfaces, as well as provide shock absorption during firing. In such a manner, the enclosure permits access at all times to the necessary movable components while ensuring a snug fit around the delicate portions of the rifle or shotgun.

11 Claims, 6 Drawing Sheets

INSULATED GUN PROTECTION ARTICLE

CROSS-REFERENCE TO RELATED APPLICATION

This application claims priority to Provisional Application 61/133,013, filed on Jun. 25, 2008, the content of which is incorporated entirely herein by reference.

FIELD OF THE INVENTION

A tight, insulating enclosure for a rifle or shotgun is provided. Such an enclosure envelops the wooden stock and other wooden portions of a suitable firearm, at least, to protect the wooden surfaces thereof during storage, transportation, and utilization. The enclosure itself contains rubber (such as a foam rubber) components to impart insulation around the wooden portions as protection against hard and/or extended surfaces that may bump, scratch, dent, or otherwise disfigure the wooden portions of a rifle or shotgun. Furthermore, the enclosure is of a single construction with suitable cut-out portions for movable parts, such as a trigger, a clip, a scope, and the like and is secured around the target firearm in a tight-fitting fashion in order to protect the noted surfaces, as well as provide shock absorption during firing. In such a manner, the enclosure permits access at all times to the necessary movable components while ensuring a snug fit around the delicate portions of the rifle or shotgun.

BACKGROUND OF THE INVENTION

Rifles and shotguns are popular items for different activities, such as hunting, skeet and other target applications, and defense (i.e., military) uses. Many rifles and shotguns are produced with wooden portions, particularly in the stock area and underneath the rear portion of the barrel. Many gun owners enjoy use of such firearms, but also prize them for the elegant manufacture of the overall article, particularly the wooden portions. As such, protection from scratches, dents, disfigurements, and other deleterious results during use, storage, transportation, and any other activity may occur without proper handling of the subject firearm. Unfortunately, when in use, such firearms are usually handled in a manner that is apposite to delicate treatment; when hunting, for example, quick movement in wooded areas is likely and consideration for delicate wooden rifle and/or shotgun portions is generally the last thing on the hunter's mind. As such, it is important to provide such protection for such a prized firearm, while still permitting proper use thereof in the aforementioned activities.

Previous attempts at providing any type of firearm surface protection, however, have focused primarily on either storing an entire gun without access for use, protecting primarily the metal portions of such a firearm, or covering the entire gun with access for a bullet to exit its muzzle. Generally, these prior gun covers were concerned with moisture barrier issues, rather than providing wooden portion protection and/or shock absorption for the user during firing. Furthermore, the previous enclosures, such as U.S. Pat. No. 3,437,247 to Gantress, U.S. Pat. No. 6,119,388 to Jones et al., and U.S. Pat. No. 7,185,607 to Pearson, all exhibit rather suspect articles that loosely envelope the subject firearm, or, as in the Gantress cover, appears to exhibit a rigidity around the subject firearm that appears rather difficult to actually handle during use. Access to triggers, sights, scopes, and ultimately the ability for a bullet to exit the subject firearm, all are compromised to a certain extent within these disclosures. The ability of the firearm user to confidently handle, maneuver, aim, and fire his rifle or shotgun is limited with these total cover articles.

To the contrary, the gun user would want a cover that targets the delicate portions of the firearm (i.e., the wooden stock, etc.), while providing not only an easy grip and hold exterior, but also shock absorption for the moment the firearm is actually discharged. Although these prior art covers may provide a certain degree of protection to the wooden portions of the subject firearm, the materials used therein are not of proper construction to impart insulation and shock absorption to deflect away from the wooden surfaces while covered. To the contrary, such materials (polyethylene, polypropylene, and the like) are intended to be transparent and/or thin to permit clear view of the firearm during use through the cover, thereby failing to provide to suitable barrier to large scratches, collisions with trees, metals, etc., during use, and thus failing to permit the user a reasonable degree of protection from such possible instances. Furthermore, the shock absorption capability of such thin film covers is, for the most part, nonexistent, thereby creating a situation wherein the user may fire the gun and, due to the resultant recoil, may lose control thereof, particularly with a loose enveloping cover in place over the target firearm.

As such, there remains a desire within the firearm industry to protect the wooden portions of a firearm primarily, as well as protect the user from the harsh recoil during firing, through the utilization of a unitary article applied over a target gun. As noted above, the concerns of the prior art were solely moisture protection; the hunter and/or shooter and/or military infantryman desires something different, particularly if protection of the wooden portions of his firearm is the primary issue, but wherein he can still fire the gun without removal thereof. As such, there remains a void in the firearm protection industry for such a development. To date, no such shock absorbing/wooden portion protecting cover article has been accorded this industry.

ADVANTAGES AND BRIEF DESCRIPTION OF THE INVENTION

A distinct advantage of the present invention is the unitary construction of the enclosure to fit most rifles and shotguns in a tight, snug fashion. Another distinct advantage is the utilization of a rubberized foam component therein with a fabric covering that accords a snug fit around the targeted wooden portions of the subject firearm. Yet another distinct advantage of the inventive enclosure is the structural configuration to releasably, yet securely, envelop the subject firearm for continuous placement thereon during use with access to all moving parts (i.e., the flintlock, the trigger, a clip, etc.) for the user. A further advantage of this invention is the shock absorption capability the rubberized foam construction imparts to the overall firearm during firing, as well as the protective enclosure provided thereby to deflect potentially harmful objects from the wooden surfaces thereof during use, storage, transportation, etc. Still another advantage is the ability to incorporate a variety of treatments into the enclosure to impart, for instance, scent lock capability, scent deflection capability, and the like, as well as the ability to attach, either releasably or permanently, cartridge holders, bullet holders, and the like, thereto, to facilitate access and transportation thereof to the user during use.

Accordingly, the invention encompasses a unitary construction enclosure for a rifle or shotgun, said enclosure configured to provide covering to the wooden portions of the rifle or shotgun, wherein said enclosure includes a rubberized foam/fabric product, wherein said enclosure is secured in releasable relation to said rifle or shotgun such that the trigger, the flintlock, and the opening in the barrel of said rifle or shotgun are not covered by said enclosure.

Such an inventive enclosure provides a number of important benefits to the gun owner and/or user. Through the utilization of a rubberized foam component with a fabric covering the enclosure imparts the necessary protection to wooden surfaces. Such a foam component, made from, for instance, polychloroprene (such as NEOPRENE® from duPont), natural rubber, nitrile-butadiene rubber (NBR), styrene-butadiene rubber (SBR), ethylene propylene diene monomer rubber (EPDM), and any cross-linked rubber formulations thereof (such as SANTOPRENE® from ExxonMobil), as well as any combinations thereof such compounds, as merely examples, exhibits a suitable resiliency to initially snugly fit around the stock, barrel, and any other wooden portions of the subject firearm. Preferably, though not necessarily, such rubber components are in a blown foam rubber form for reduced density and suitable impact resistance. The fabric applied over or around the rubber (and/or rubberized foam) component then provides a covering to that component, as well as a form to the overall structure to impart the snug fit as needed. The fabric may be of any structure, woven or knit, preferably, that imparts such desirable covering and resiliency. Such a fabric should, however, be of primarily synthetic structure, such as polyamide (nylon 6,6, nylon 6, and the like), polyester (such as polyethylene terephthalate, as one example), polyacrylate (acrylic yarns, acrylonitrile, as examples), polyvinylchloride, polyolefin (such as polypropylene, polyethylene, blends thereof, and the like, as examples), and the like. Natural fibers may be incorporated as well if desired, but the majority of the fabric structure should be synthetic in nature, particularly to impart a protective cover that can withstand outdoor elements without degrading over time and repeated use. A woven structure provides an effective pattern for gripping by the user, if desired, as well. Preferably, the overall construction is made from a 51% neoprene (remainder a mix of natural rubber and styrene-butadiene rubber) base with a woven 100% nylon 6,6 fabric. A 10-11% neoprene with other rubberized fillers (natural rubber, SBR, as examples) may be employed as well. The actual weave structure is not of enormous importance, thus the number of picks per inch may be within a wide range. Any knit structure that comports to a fabric for such a covering may also be utilized.

The insulation component (rubber and/or rubberized foam) should be at least 3 millimeters in thickness over the protected surfaces. The fabric applied thereto may thus be of suitable thickness to provide the protection to the rubber portion, such as a range of 1 to 3 millimeters. The thickness provides the benefit of object deflection away from unwanted collisions, as well as supplies the necessary shock absorption for the user during firing. The fabric surface may be patterned with any designs the user desires. Camouflage patterns are particularly popular in hunting environments, for instance. As well, the rubber and/or the fabric may be treated with scents or scent covers; in particular, the fabric may include a pocket therein for introduction of a scent cartridge or like device for such a purpose. Furthermore, the fabric surface may be configured to allow for adhesive facilitation of hook and loop fasteners (such as VELCRO® strips, from The Velcro Company), or like components, to permit any attachments of suitable articles for any variety of functions. For instance, bullet holders may be attached in such a manner to allow for the user to easily access such implements for quick loading, if desired. Likewise, extra shot shells may be permitted access in the same manner (other implements may include, without limitation, flashlights, pen knives, pencils, keys, etc.).

The drawings below will provide an overall description of the inventive unitary construction article. It is important to note, however, that this single construction article permits covering of the stock and portion of the barrel (and other wooden components) of a shotgun or rifle. The construction may be configured to cover as much of the barrel as desired (as it is not a moving part per se of the firearm), all the way to the lip of the barrel itself. The enclosure should not, however, cover the exit opening of the barrel to any degree. The foam rubber/fabric product, though, if applied over the barrel in such a fashion, provides an extra benefit to the user in that once the firearm is discharged, the user may apply his hand to the barrel immediately thereafter without any appreciable degree of exothermic result as the insulating enclosure not only provides for shock absorption and deflection capabilities from collisions, but, since there is a significant amount of air within the foam rubber component, imparts a heat resistance for the user as well. The noted prior art enclosures, being solely of polypropylene and/or polyethylene in constituency, would be susceptible to melting and/or deformation upon discharge and wrapping around the subject firearm's barrel thereafter. Thus, the inclusion of the important foam rubber (i.e., neoprene, for instance) provides yet another benefit to the user.

Upon enclosure of the configured areas of the subject gun, the user will be able to secure the enclosure around certain portions of the subject firearm through a zipper, VELCRO®-like, or any other similar device. The entire enclosure is configured to easily permit the barrel of the subject firearm to insert into an opening in the enclosure wherein such an enclosure opening is then pulled down over the firearm barrel until the firearm is too wide for further passage. Simultaneously, or sequentially, the wooden stock cover portion of the enclosure is then in place to envelop such a firearm portion upon proper movement thereto by the user. Once in place over the wooden stock, the user can then affix the entire enclosure through the utilization of, as noted above, as one example, a zipper running along the top horizontal portion of the wooden stock cover. Such a zipper, if present, is preferably plastic, or any other type of material that will not itself appreciably scratch or disfigure the wooden portions of the subject firearm. As noted above, proper cutout portions within the enclosure are present such that the flintlock, the trigger and the exit opening of the barrel are not covered, at least, upon complete enveloping of the wooden surfaces of the subject firearm by the inventive enclosure. Such cutout portions allow for access to the user for movable parts (and would include cartridge loading and replacement, scope or sight access, muzzle loading possibilities, chamber ejection of bullets or shells, etc.) and thus the enclosure is not intended to protect such movable parts from moisture (although the enclosure may also cover metal portions of the subject firearm that are not considered movable in this sense; for instance, the vertical sides of the bullet or shell chamber of the rifle or shotgun are not movable, but house the ammunition prior to discharge; the enclosure may be configured to cover such a chamber if desired since ejection of the bullet and/or shell typically takes place at the top or bottom of the chamber).

Furthermore, the enclosure is of suitable flexibility to permit the user to open a shotgun for replacement of shells without any need for removing or otherwise adjusting the enclosure itself. Additionally, if the enclosure is applied to a rifle, the flexibility of the enclosure, as well as the overall configuration thereof, will permit bolt action movement without movement or adjustment of the enclosure as well.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DETAILED DESCRIPTION OF THE DRAWINGS AND PREFERRED EMBODIMENTS

The accompanying drawings and the description which follows set forth this invention in its preferred embodiment. However, it is contemplated that persons generally familiar with firearms and firearm covers will be able to apply the novel characteristics of the structures illustrated and described herein in other contexts by modification of certain details. Accordingly, the drawings and description are not to be taken as restrictive on the scope of this invention, but are to be understood as broad and general teachings.

Figure 1:
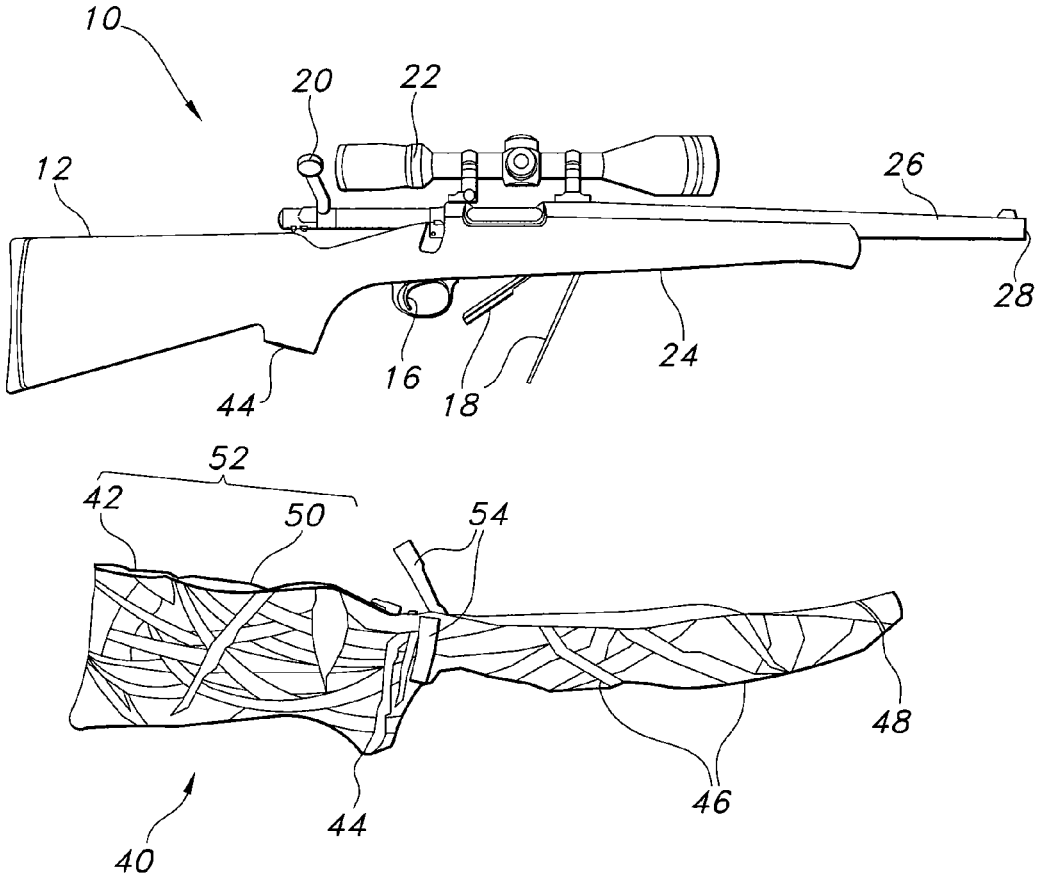
FIG. 1 is a perspective view of an inventive rifle enclosure adjacent to a subject rifle, prior to application of the enclosure thereto.

FIG. 1 shows a rifle 10 with a wooden stock 12, an arm rest 14, a trigger mechanism 16, a cartridge entry portion 18, a bolt action bullet delivery device 20, a scope 22, a body portion 24, and a barrel 26 including an opening for exist of a bullet 28. The associated enclosure 40 is of unitary construction having a stock end 42, configured and shaped to complement the general shape of a rifle stock 12, an arm rest portion 44, configured and shaped to complement the same portion of the rifle 14, a body portion 46, configured and shaped to complement the body portion of the rifle 24, and a barrel end 48, including an opening therein (not illustrated) to allow for insertion and pass-through of the barrel 26 of said rifle 10. Also present is a plastic zipper portion 50 on the top horizontal portion 52 of the enclosure 40 as a closing means of the enclosure 40 around the rifle stock 12 and arm rest 14. Also present is a securing means (here a VELCRO® belt 54 disposed in the general area below a bolt action bullet delivery device (or optionally flintlock) opening (not illustrated) to secure the enclosure in that area of the rifle 10. Also present in the enclosure 40 are openings (not illustrated) for insertion of the trigger mechanism 16 and the cartridge entry portion 18 of the rifle 10.

Figure 2:
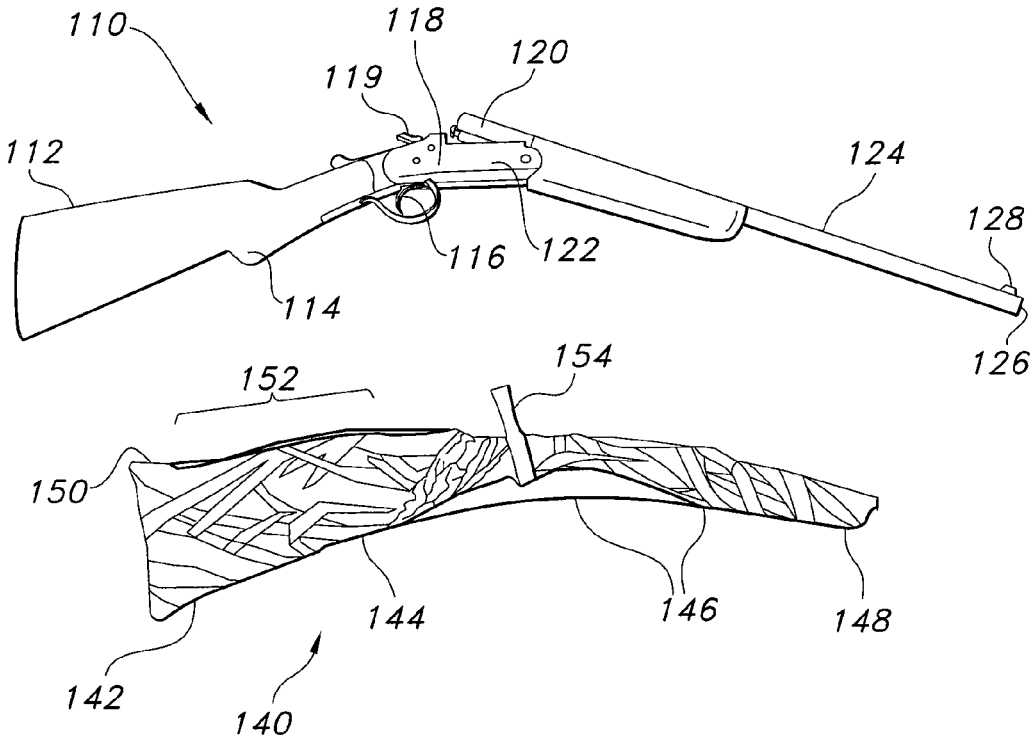
FIG. 2 is a perspective view of an inventive shotgun enclosure adjacent to a subject shotgun, prior to application of the enclosure thereto.

FIG. 2 shows a shotgun 110 with a wooden stock 112, an arm rest 114, a trigger mechanism 116, a shell chamber portion 118, a flintlock 119, a movable loader 120, a body portion 122, a barrel 124 including an opening for exit of a bullet 126, and a sight 128. The associated enclosure 140 is of unitary construction having a stock end 142, configured and shaped to complement the general shape of a shotgun stock 112, an arm rest portion 144, configured and shaped to complement the same portion of the shotgun 114, a body portion 146, configured and shaped to complement the body portion of the shotgun 122, and a barrel end 148, including an opening therein (not illustrated) to allow for insertion and pass-through of the barrel 124 of said shotgun 110. Also present is a plastic zipper portion 150 on the top horizontal portion 152 of the enclosure 140 as a closing means of the enclosure 140 around the shotgun stock 112 and arm rest 114. Also present is a securing means (here a VELCRO® belt 154 disposed in the general area adjacent the movable loader 120 and flintlock 119 opening (not illustrated) to secure the enclosure in that area of the shotgun 110. Also present in the enclosure 140 are openings (not illustrated) for insertion of the trigger mechanism 116 of the shotgun 110.

Figure 3:
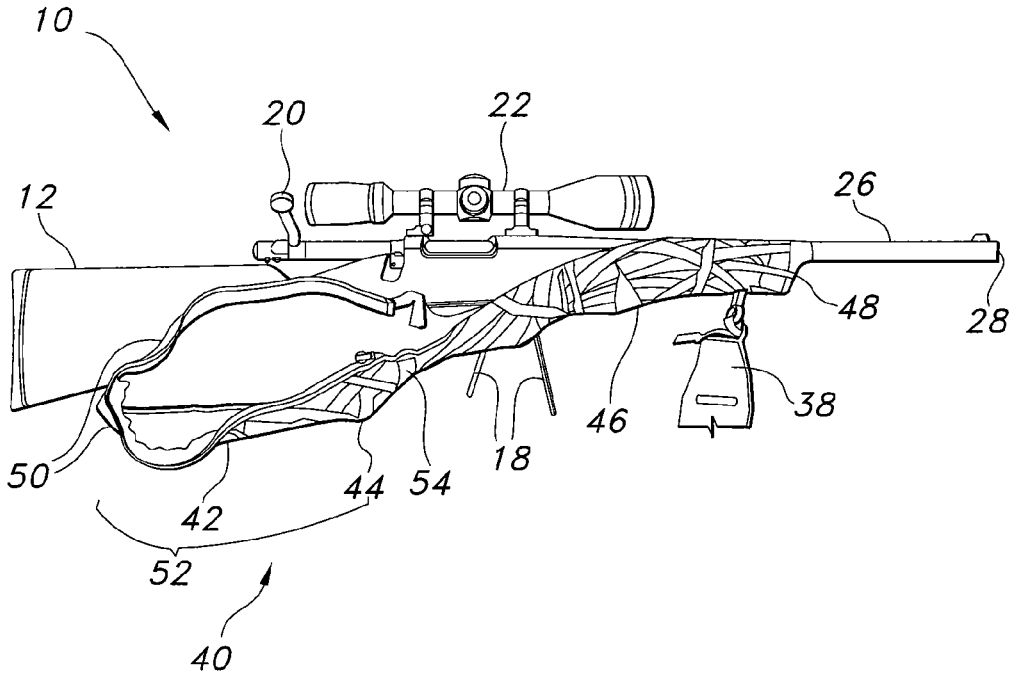
FIG. 3 is a perspective view of a partially enveloped subject rifle with the inventive enclosure subsequent to application of said enclosure over the barrel portion of the rifle.

FIG. 3 shows the partial covering of the rifle 10 with the enclosure 40 wherein the barrel 26 of the rifle 10 has been inserted into the barrel end 48 of the enclosure 40. The stock end 42 of the enclosure 40 is opened to receive the stock 12 of the rifle 10. Noticeably, the top horizontal portion 52 of the enclosure 40 including the zipper portion 50 is open in this fashion. The barrel end 48 and some of the body portion 46 of the enclosure 40 are already tightly and snugly fit around some of the body portion of the rifle 24. Attached to the rifle 10 is also a cut-away view of a removable shoulder strap 38 to facilitate carrying, if desired.

Figure 4:
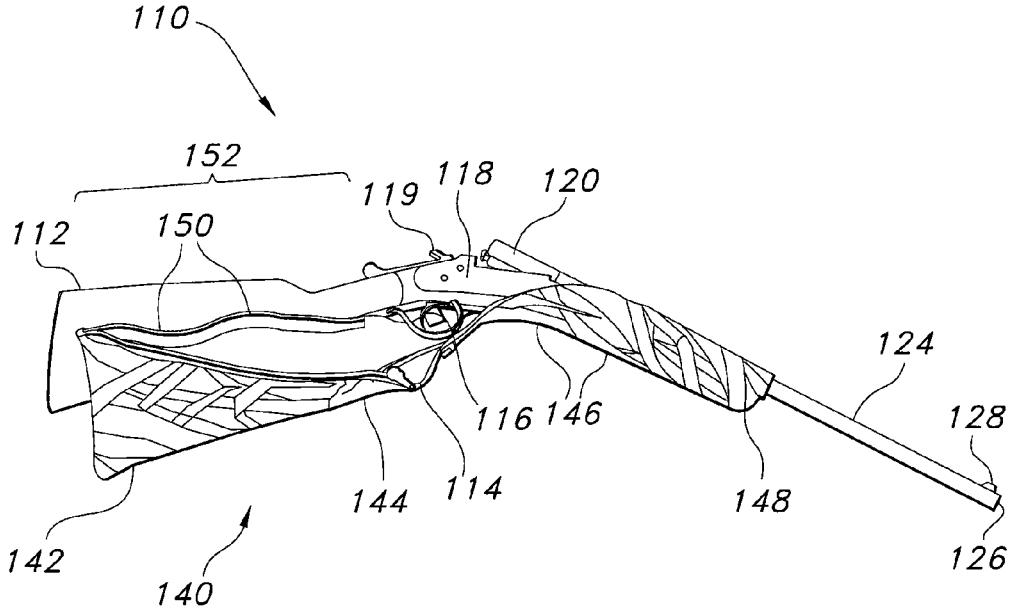
FIG. 4 is a perspective view of a partially enveloped subject shotgun with the inventive enclosure subsequent to application of said enclosure over the barrel portion of the shotgun.

FIG. 4 shows the partial covering of the shotgun 110 with the enclosure 140 wherein the barrel 124 of the rifle 110 has been inserted into the barrel end 148 of the enclosure 140. The stock end 142 of the enclosure 140 is opened to receive the stock 112 of the shotgun 110. Noticeably, the top horizontal portion 152 of the enclosure 140 including the zipper portion 150 is open in this fashion. The barrel end 148 and some of the body portion 146 of the enclosure 140 are already tightly and snugly fit around some of the body portion of the rifle 122.

Figure 5:
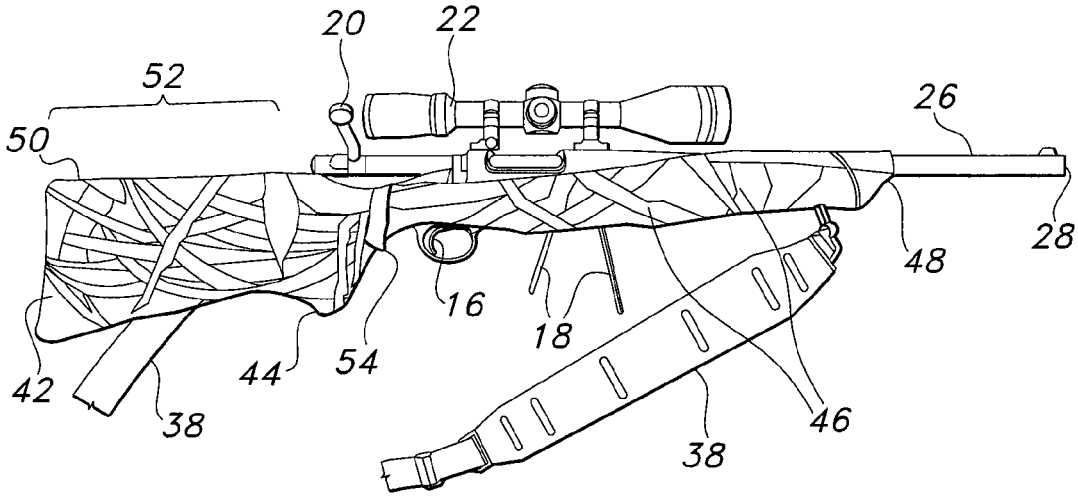
FIG. 5 is a perspective view of a fully enveloped subject rifle with the inventive enclosure applied thereto.

FIG. 5 thus shows the complete application of the enclosure 40 over the rifle 10. The stock (12 of FIG. 1) and arm rest portion (14 of FIG. 1) of the rifle 10 have been inserted within the enclosure's stock end 42 as well as the arm rest portion 44 thereof. Subsequent to the initial insertion of the barrel 26 within the enclosure 40 in FIG. 3, the insertion of the stock and arm rest portion as above, coupled within the activation of the closing means (here, the zipper portion 50 on the top horizontal portion 52 of the enclosure 40) as well as the attachment of the securing means 54, the rifle 10 is covered over the wooden areas, and the movable parts (trigger mechanism 16, bolt action bullet delivery device 14, cartridge entry portion 18) and the scope 20 as well as the exit opening 28 on the barrel 26, are not covered by the enclosure 40.

Figure 6:
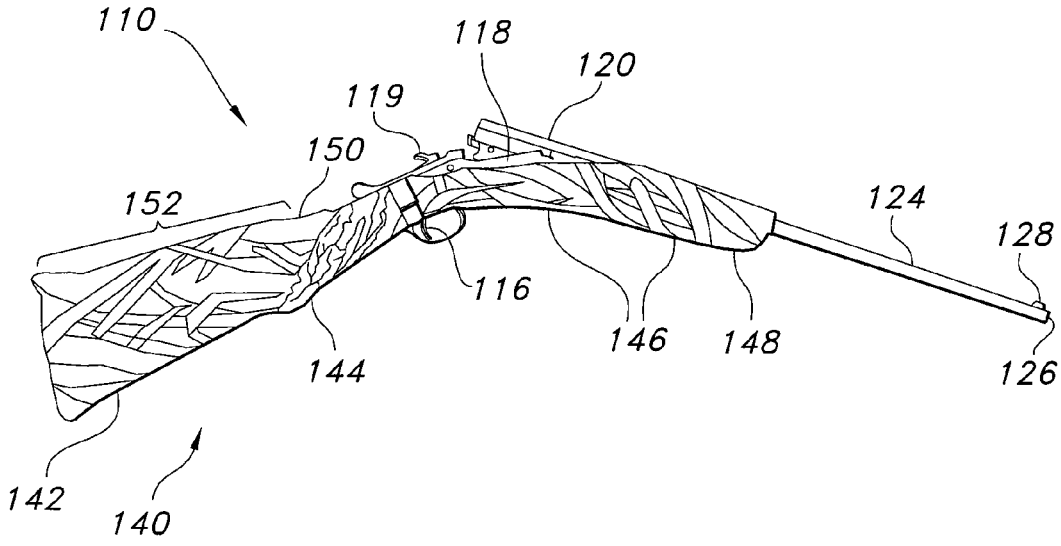
FIG. 6 is a perspective view of a fully enveloped subject shotgun with the inventive enclosure applied thereto.

FIG. 6 thus shows the complete application of the enclosure 140 over the shotgun 110. The stock (112 of FIG. 2) and arm rest portion (114 of FIG. 2) of the shotgun 110 have been inserted within the enclosure's stock end 142 as well as the arm rest portion 144 thereof. Subsequent to the initial insertion of the barrel 124 within the enclosure 140 in FIG. 4, the insertion of the stock and arm rest portion as above, coupled within the activation of the closing means (here, the zipper portion 150 on the top horizontal portion 152 of the enclosure 140) as well as the attachment of the securing means 154, the rifle 110 is covered over the wooden areas, and the movable parts (trigger mechanism 116, flintlock 119, and movable loader 120) and the sight 128 as well as the exit opening 126 on the barrel 124, are not covered by the enclosure 140.

In this manner, the insulating rubberized foam/fabric product enveloping the wooden portions of the rifle or shotgun provide the desired protection thereof, as well as an appreciable degree of shock absorption during recoil during firearm discharge. The firearm may thus be used as desired by the hunter and/or shooter without any adjustments of the enclosure at all. As such, the enclosure acts as an extension of the firearm, allowing for ease in handling, particularly if the barrel or other metal portions exhibit an exothermic result subsequent to discharge, with the desired protections in place for the wooden surfaces thereof.

What we claim is:

1. A unitary construction enclosure for providing covering to portions of a rifle or shotgun, said rifle or shotgun including, at least, a trigger, a barrel including an exit opening, a stock, and a portion underneath said barrel; said enclosure configured to provide covering to said stock and said portion underneath said barrel; wherein said enclosure includes an opaque product including a rubber component and a fabric component; wherein said enclosure is secured in releasable relation to said rifle or shotgun; wherein said enclosure secures to and encloses said stock of said rifle or shotgun through a single horizontally configured closing means; wherein upon securing said enclosure to said rifle or shotgun, said enclosure does not cover said trigger nor said exit opening in said barrel; and, wherein said enclosure is configured to form to the shape of said rifle or shotgun.

2. The enclosure of claim 1 wherein said opaque product includes a rubber component selected from the group consisting of natural rubber, polychloroprene, styrene-butadiene rubber, ethylene propylene diene monomer rubber, cross-linked rubbers thereof, and any combination thereof, and a fabric made primarily of synthetic fibers.

3. The enclosure of claim 1 wherein said opaque product is configured such that the fabric component is exterior on said enclosure in relation to said rifle or shotgun.

4. The enclosure of claim 3 wherein said fabric component includes a pattern on the surface thereof.

5. A unitary construction cover for a rifle or shotgun, said rifle or shotgun including at least, a trigger, a barrel including an exit opening, a stock, and a portion underneath said barrel; said cover configured to provide covering to said stock and said portion underneath said barrel of said rifle or shotgun while simultaneously remaining in contact with said barrel; wherein said enclosure is configured such that upon securing said enclosure to said rifle or shotgun, said enclosure does not cover the trigger nor said exit opening in said barrel; wherein said cover is secured in releasable relation to said rifle or shotgun; wherein said cover secures to and encloses said stock of said rifle or shotgun through a single horizontally configured closing means; and, wherein said enclosure is configured to form to the shape of said rifle or shotgun.

6. A method of protecting a rifle or shotgun through the utilization of a unitary insulating cover, said rifle or shotgun comprising at least, a trigger, a barrel including an exit opening, a stock, and a portion underneath said barrel; wherein said unitary cover comprises a barrel cut-out portion, a trigger cut-out portion, and a stock cover portion, as well as means to securely attach said cover to said stock in releasable fashion; wherein said unitary cover is configured to provide covering to said stock and said portion underneath said barrel while attached in releasable fashion to said rifle or shotgun; wherein said cover does not cover either of said trigger or said exit opening of said barrel while attached in releasable fashion to said rifle or shotgun; wherein said cover secures to and encloses said stock of said rifle or shotgun through a single horizontally configured closing means; and, wherein said enclosure is configured to form to the shape of said rifle or shotgun; said method including the steps of:

a) providing said unitary insulating cover;

b) introducing said barrel through said barrel cut-out portion; and c) introducing said stock of said shotgun or rifle into said unitary insulating cover and operating said attachment means to secure said cover to said stock.

7. The method of claim 6 wherein said cover comprises an opaque product including a rubber component and a fabric component.

8. The method of claim 7 wherein said opaque product includes a rubber component selected from the group consisting of natural rubber, polychloroprene, styrene-butadiene rubber, ethylene propylene diene monomer rubber, cross-linked rubbers thereof, and any combination thereof, and a fabric made primarily of synthetic fibers.

9. The cover of claim 7 wherein said opaque product is configured such that the fabric component is exterior on said enclosure in relation to said rifle or shotgun.

10. The cover of claim 7 wherein said fabric component includes a pattern on the surface thereof.

11. The cover of claim 9 wherein said fabric component includes a pattern on the surface thereof.

* * * * *